US006276569B1

(12) United States Patent
Tsai

(10) Patent No.: US 6,276,569 B1
(45) Date of Patent: Aug. 21, 2001

(54) LIQUID CONTAINER PRESS BOTTLE CAP

(76) Inventor: Chun-Lung Tsai, No. 491, Mei Lun Road, Changhua City (TW)

( * ) Notice: Subject to any disclaimer, the term of this patent is extended or adjusted under 35 U.S.C. 154(b) by 0 days.

(21) Appl. No.: 09/660,481

(22) Filed: Sep. 12, 2000

(51) Int. Cl.[7] ..... B65D 88/54
(52) U.S. Cl. ..... 222/321.9; 222/321.7; 222/385
(58) Field of Search ..... 222/321.1, 321.7, 222/321.9, 385, 321.2, 192

(56) References Cited

U.S. PATENT DOCUMENTS 1,057,982 * 4/1913 Rachmann ..... 222/321.7
3,216,625 * 11/1965 Corsette ..... 222/321.7
5,083,684 * 1/1992 Ebina et al. ..... 222/394
5,348,174 * 9/1994 Velicka ..... 215/277
5,692,648 * 12/1997 Su ..... 222/321.2
6,053,363 * 4/2000 Revenu ..... 222/82
6,065,640 * 5/2000 Ho et al. ..... 222/78

FOREIGN PATENT DOCUMENTS

2231096A * 11/1990 (GB) .

* cited by examiner

*Primary Examiner*—Kevin Shaver
*Assistant Examiner*—Frederick C Nicolas
(74) *Attorney, Agent, or Firm*—Rabin & Champagne, P.C.

(57) ABSTRACT

A liquid container press bottle cap having a metal exterior structure that constitutes an improved press bottle cap capable of matching the luster and sheen of metal liquid containers.

5 Claims, 4 Drawing Sheets

LIQUID CONTAINER PRESS BOTTLE CAP

BACKGROUND OF THE INVENTION

1. Field of the Invention

The invention herein relates to a liquid container press bottle cap having a metal exterior structure and constituting an improved press bottle cap that matches the luster and sheen of metal liquid containers.

2. Description of the Prior Art

The press bottle cap shown in FIG. 4 is widely utilized on various household-use liquid containers holding contents such as bathing, cleaning and scented soap fluids, etc. and thereby providing consumers unlimited convenience. Since the various liquid containers are typically fabricated of plastic and the specialized makers of such bottle caps all manufacture products constructed of a common plastic material, the colors and shapes are so similar that product differentiation is difficult. However, with the diversification of industrial product design, the availability of a selectable range of materials now allows for greater variation to the extent that having to utilize plastic material exteriors for conventional plastic fabricated press bottle caps is no longer necessary.

In view of the situation, the inventor of the invention herein, based on numerous years in the industry and accumulated design experience, conducted research on the structure and characteristics of the conventionally utilized press bottle caps to provide an improved liquid container press bottle cap that completely solves the conventional shortcomings.

SUMMARY OF THE INVENTION

The primary objective of the invention herein is to provide a liquid container press bottle cap including a press head, a rotatable base, and other exposed components ensleeved in a metal exterior such that the press bottle cap manifests a silver metal luster and, furthermore, since the metal exterior can be surface treated in various different hues such as bronze, gold, silver, or the five primary colors to match the exterior of a particular product series, the present invention can be matched with stainless steel finished, chrome plated, and other differently finished liquid containers to visually convey that a certain product belongs to similar series of products and thereby achieve product uniformity and coordination.

To enable a further understanding of the technological means, innovative features, objectives, and functions of the invention herein, the brief description of the drawings below are followed by the detailed description of the invention.

DETAILED DESCRIPTION OF THE INVENTION

Figure 1:
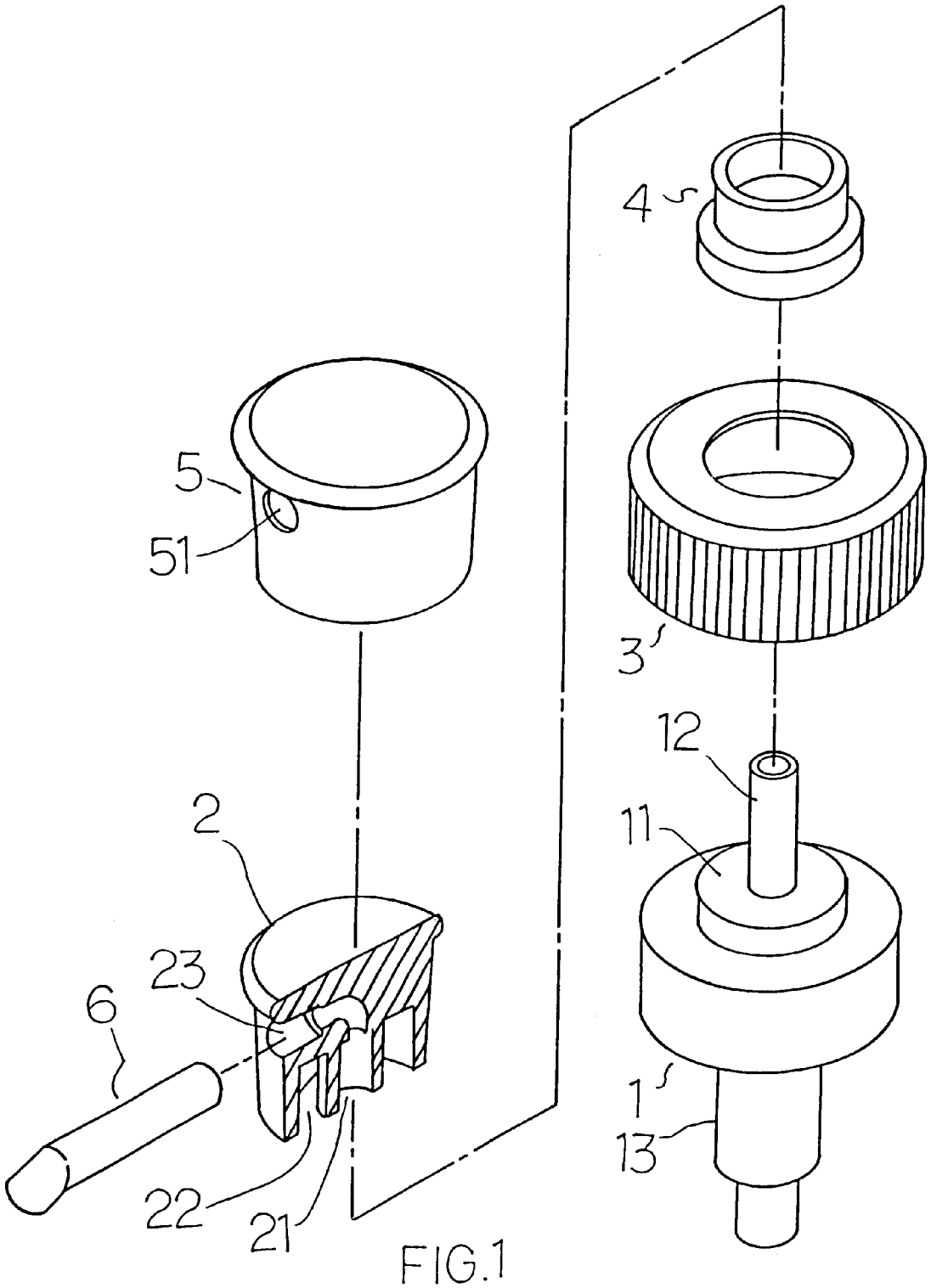
FIG. 1 is an exploded drawing of the invention herein.

Referring to FIG. 1, the improved features of the invention herein include a rotatable base 1 of a press bottle cap, a press head 2 ensconced in a metal fabricated fitting mount 3, a coupling sleeve 4, a press sleeve 5, and an output tube 6.

The fitting mount 3 is ensleeved and fixed onto the rotatable base 1, thereby completely covering the rotatable base 1. Furthermore, the rotatable base 1 has disposed in it an extendible and retractable tube 12 capable of being lengthened and shortened as well as an input tube 13 and other structures identical to those of conventionally utilized structures. Furthermore, since the structures are not included among the innovative features claimed by the invention herein, they are not further described. The rotatable base 1 has formed at its top a projecting ring 11 that provides for the fixing of the coupling sleeve 4. The press head 2 has formed in it an insertion hole 21 that provides for the insertion of the extendible and retractable tube 12. Furthermore, press head 2 has an annular recess 22 that provides for the forced seating of the press head 2, which when seated in provides for the fitting of the coupling sleeve 4. Formed in the surrounding wall is a horizontal hole 23 which, after the press sleeve 5 is fully ensleeved over the press head 2, is aligned with an opening 51 that provides for the entry and fixing of the metal output tube 6.

Figure 2:
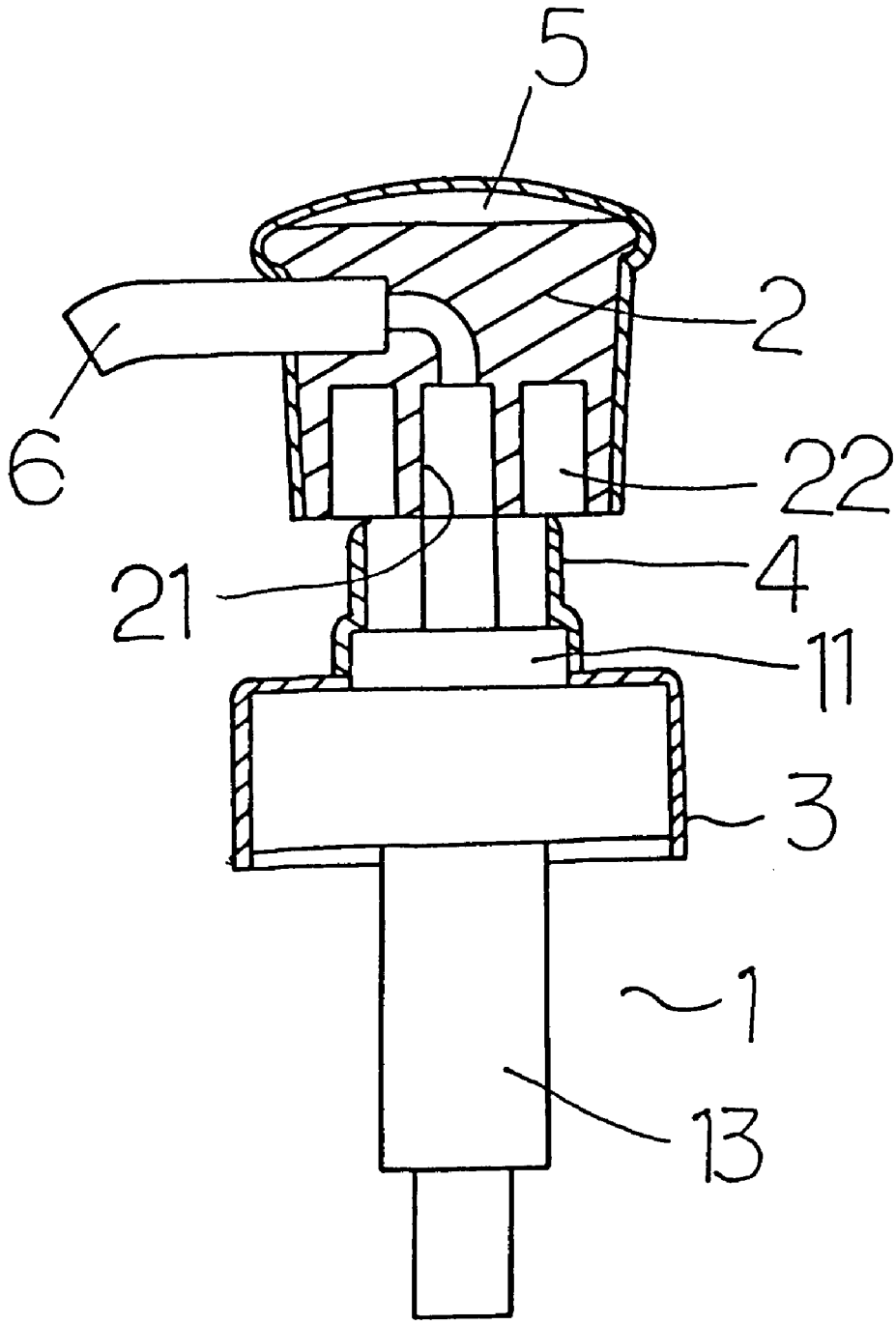
FIG. 2 is a cross-sectional drawing of the invention herein.
Figure 3:
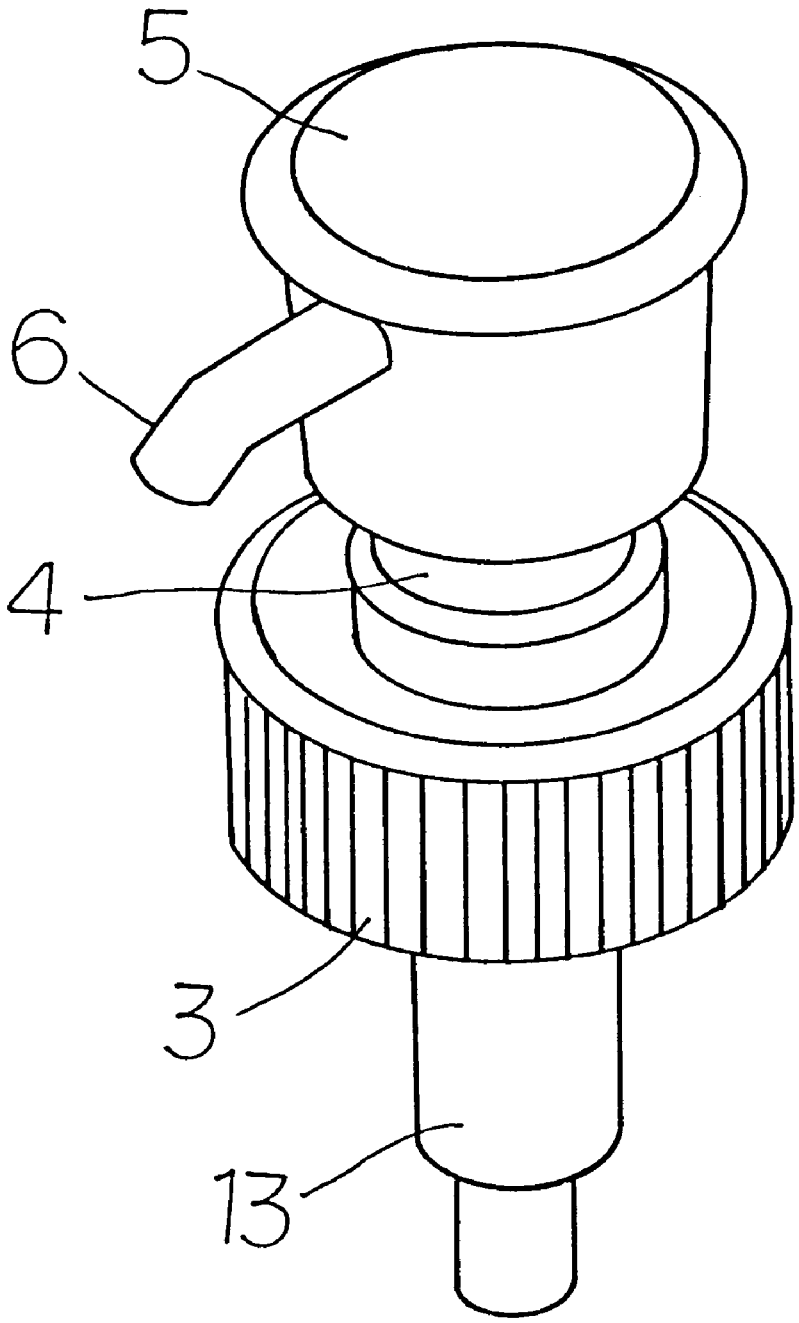
FIG. 3 is an isometric drawing of the fully assembled invention herein.
Figure 4:
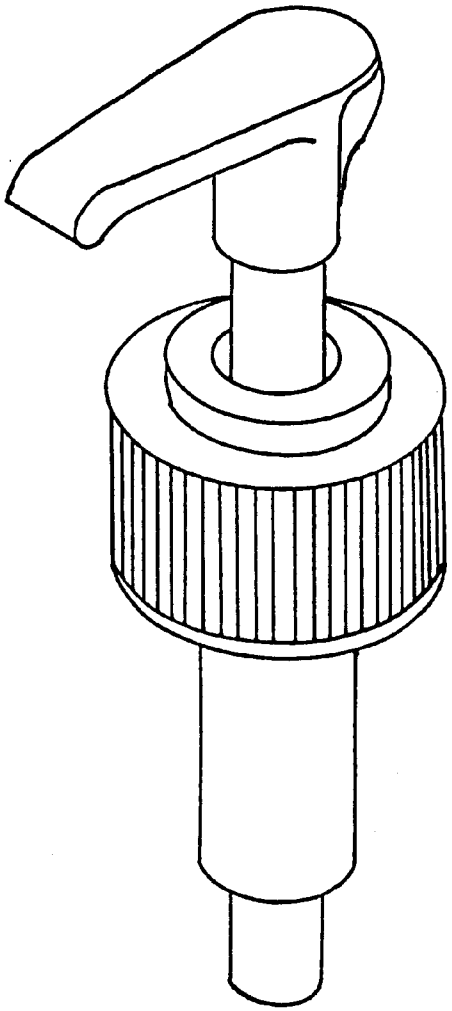
FIG. 4 PRIOR ART
FIG. 4 is an isometric drawing of a conventionally utilized entity.

The components are assembled, as indicated in FIG. 2 and FIG. 3, to complete a metal exterior press bottle cap that has numerous advantages over the conventional plastic fabricated products:

1. The metal exterior matches that of metal fabricated liquid containers and since this visually conveys belonging to a similar series of products, product uniformity and the coordination thereof is achieved.

2. In addition to the luster of naturally finished metal, the exteriors of the metal fabricated fitting mount 3, coupling sleeve 4, press sleeve 5, and output tube 6 can be finished with different lusters by surface treatments such as gold plating, chrome plating, and color plating, etc. to match the sheen of different product series, thereby providing for a selectable range of product material design that effectively increases the added-value of products without limitation.

In summation of the foregoing section, since the embodiments of the invention herein are capable of achieving the claimed utilization and functions and, furthermore, the structures of the disclosure have not been observed in the same product category or previously submitted publicly for patent application, the present invention fully meets the regulations and requirements of the patent law and is lawfully submitted for review and the granting of the commensurate patent rights.

What is claimed is:

1. A liquid container press bottle cap, comprising:

a rotatable base having a projecting ring formed at a top thereof, an input tube disposed at a bottom thereof, and an extendible and retractable tube disposed at the top;

a press head having a horizontal hole and an insertion hole in fluid communication with the horizontal hole, said extendible and retractable tube being fitted within the insertion hole;

a fitting mount forming a sleeve that fits around the top of said rotatable base;

a coupling sleeve fitted around said projecting ring;

a press sleeve surrounding said press head, and having a hole disposed in alignment with the horizontal hole, said press sleeve and said press head having corresponding shapes; and an output tube extending through the hole in said press sleeve and being fixed within the horizontal hole.

2. The liquid container press bottle cap recited in claim 1, wherein at least one of said press sleeve, said output tube, said coupling sleeve and said fitting mount are comprised of metal.

3. The liquid container press bottle cap recited in claim 1, wherein each of said press sleeve, said output tube, said coupling sleeve and said fitting mount are provided with at least one of a gold plating, chrome plating and color plating.

4. The liquid container press bottle cap recited in claim 1, wherein said press head has an annular recess surrounding the insertion hole, said coupling sleeve being receivable within the annular recess.

5. The liquid container press bottle cap recited in claim 1, wherein each of said press sleeve, said output tube, said coupling sleeve and said fitting mount are comprised of metal.

* * * * *